US006497641B1

(12) United States Patent
Hinds

(10) Patent No.: US 6,497,641 B1
(45) Date of Patent: Dec. 24, 2002

(54) SLOTTED EXERCISE HANDGRIP

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 0 days.

(21) Appl. No.: 09/626,552

(22) Filed: Jul. 27, 2000

(51) Int. Cl.[7] ..... A63B 21/02
(52) U.S. Cl. ..... 482/126; 121/124
(58) Field of Search ..... 482/49, 126, 122, 482/124, 121, 74, 125, DIG. 9, 904, 129

(56) References Cited

U.S. PATENT DOCUMENTS

| | | | | | |
|---|---|---|---|---|---|
| 113,384 | A | * | 4/1871 | Basnett | 482/126 |
| 232,579 | A | | 9/1880 | Weeks | |
| 652,617 | A | * | 6/1900 | Hotz | 482/126 |
| 3,427,023 | A | * | 2/1969 | Silberman | 482/126 |
| 5,431,617 | A | | 7/1995 | Rattray, Jr. | 482/129 |
| 5,505,677 | A | | 4/1996 | Hinds | 482/10 |
| 5,549,532 | A | | 8/1996 | Kropp | 482/126 |

* cited by examiner

*Primary Examiner*—Jerome W. Donnelly
(74) *Attorney, Agent, or Firm*—Loyd W. Bonneville

(57) ABSTRACT

An anchor block having within it a slot as to provide a solid handgrip, strapped handgrip assembly, ankle exercise cuff assembly or anchoring door impingement assembly all of which permit quick and easy interchangeability of a stoppered elastic exercise cord. The slot may be shaped in any of several ways including straight, zigzag or curved.

17 Claims, 11 Drawing Sheets

SLOTTED EXERCISE HANDGRIP

BACKGROUND OF THE INVENTION

1. Field of the Invention

Gymnastic Equipment

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term cord anchor block (1) might be used in one instance but in another, of meaning is otherwise clear from context, expression might be shortened to anchor block (1) or merely block (1). Any of those forms is intended to convey the same meaning. The terms attach or fasten or any of their forms when so used means that the juncture is of a more or less permanent nature, such as might be accomplished by bolts, welds or adhesives. Thus it is stated herein concerning the connection of the handgrip strapping (310) and an anchor block (1) that a given strap end (311) is attached back upon the strapping (310) by stitching. A connection in which one object is easily removed from another is described by the word emplace, as where it is stated herein that the elastic exercise cord (100) is emplaced within the cord anchor block (1). A connection in which two objects, although not attached, are separated only with considerable difficulty—such as the connection of a cord terminal stopper (101) proximate the hollowed end of an elastic exercise cord (100) is referred to herein as one of rigid emplacement. Employment of the words connector join or any of their forms is intended to include the meaning of any of those terms in a more general way.

The word comprise may be construed in either of two ways herein. a term used to describe an object is said to comprise it, thereby characterizing the object with equivalency in meaning for the term. Thus, in a given instance, the cord connecting slot (18) may be said to comprise a straight slot (41), meaning that the connecting slot (18) is indeed a straight one (41).

However, the word comprise may also be used to describe a feature which is part of the structure or composition of a given object or assembly. Thus, a strapped handgrip assembly (151) may be said to comprise handgrip strapping (310), meaning that the structure of the handgrip assembly (151) is such as to have the strapping (310) as a feature of its (151) structure. The meaning in the respective cases is clear from context, however. Accordingly, modifying words to clarify which of the two uses is the intended one seem unnecessary.

Terms relating to physical orientation such as top or bottom, upper or lower, refer to the positioning of the slotted exercise handgrip in the manner in which it is typically observed with the emplaced exercise cord (100) hanging freely from it. Thus, the cord terminal stopper (101) rigidly emplaced within the exercise cord (100) proximate its (100) end is spoken of as being disposed proximate the top of the cord anchor block (1) and the remaining portion of the cord (100), as running form the bottom thereof (1).

Many who engage in exercise prefer a system employing elastic cord (100) over one in which weights are disposed. Advantages include portability, noise reduction, storage convenience and the resistance gradient provided by the cord (100) itself. Shorter or longer ones (100) may be interchanged and operators (200) of differing exercise capabilities may substitute one (100) of lesser or greater elasticity to suit his (200) or her (200) respective needs.

It should be recognized, of course, that for decades, operators (200) have also engaged devices with a part of their body other than the hand. For example, the operator's (200) tension situs might be the arm, wrist, leg, foot, neck, head or even the fingers and thumb in appropriate cases. A traditional handgrip might, thus, have been fitted around one or both ankles for one or another of a number of familiar exercises.

In general, two sorts of handgrips have emerged—a solid handgrip comprising enclosed loop, horseshoe or stirrup configuration (150) and a strapped handgrip assembly (151) in which handgrip strapping (310) is connected to the exercise cord (100) by one means or another.

Interface between cord (100) and handgrip, whether of the closed loop (150) or the strapped assembly (151) variety, ante, soon provided a challenge. Of course, knotting was always a possibility but provided interchangeability inconvenience. Elastic cording (100) which was tubular or hollow throughout its (100) length became commercially available and in a matter of time, it occurred to some that a hole could be provided within the handgrip or handgrip assembly (150, 151, respecively) through which an elastic cord (100) could be extended and a cord terminal stopper (101) affixed within the hollow proximate the cord's (100)

Elastic cord (100) length has traditionally been accomplished in the following manner: Once the approximate length of the cord (100) is determined, that is—having been cut to approximately desired length—a stopper (101) of slightly greater width than that of the cord (100) is inserted within the hollow of the tubing. The stopper (101) is effectually pinched in place. The length of the exercise cord (100) may be more specifically or finely adjusted by sliding to stopper (101) either toward or away from the cord's (100) end. By reason of friction attending the cord's (100) elasticity, however, the stopper (101) is slid in that fashion, inserted or removed only with considerable difficulty.

Thus, it was soon observed that while the stoppers (101) were acceptably secured in place, cord (100) interchangeability was not practically feasible. The stopper (101) in such instances is extremely difficult to remove and reinstall in the substituting cord (100). The same is true of cord (100) connection to a door impingement assembly (313)—comprising an impingement strap (319) which at an end (311) has an enlargement such that when it (319) is impinged between the door and its frame to hold it (319) in place to secure an exercise cord (100) connected to the assembly (313), it (319) cannot be pulled out of place. Thus, if it were necessary to connect the cord (100) at one end to what is referred to herein as a representative handgrip (850) or to an ankle exercise cuff assembly (314) and at the other end to a door impingement assembly (313), twice the inconvenience would ordinarily be encountered. If a number of cords (100) were to be connected to any one of a number of representative handgrips (850) for simultaneous use, the task becomes even more difficult.

What is needed is some means by which the stoppered cord (100) can quickly and easily be disconnected from and connected to any representative handgrip (850), door impingement assembly (313) or any of a number of other operator (200) manipulators such as an ankle exercise cuff assembly (314) and the like.

Much of this seems to have begun with U.S. Pat. No. 232,579 issued to Weeks in which an exercise assembly was tethered to a wall with a combination of pulleys and interconnected cords, both elastic (100) and inelastic.

Patents more recently employing stoppered elastic cords (100) include U.S. Pat. No. 5,505,677 issued to Hinds, also the applicant herein, and U.S. Pat. No. 5,549,532 issued to Kropp. Interchangeability for either of them requires the more laborious removal and reinsertion of the stopper (101).

U.S. Pat. No. 5,431,617 issued to Rattray, Jr. features an exercise assembly employing several elastic cords (100) simultaneously but does not include means for their expedient interchangeability.

A review of the prior art readily reveals that the needs and objectives which have arisen have not thus far been realistically met.

SUMMARY OF THE INVENTION

The invention comprises three embodiments of a slotted exercise handgrip. The heart of its structure is a cord anchor block (1) configured in various forms so as to provide those embodiments. At a minimum, however, each comprises the anchor block (1).

In all cases, a cord terminal bore (16) is present which allows a hollow elastic exercise cord (100) to be extended through it (16), the end of which is then plugged with a stopper (101) in a manner now familiar to prior art. The terminal bore (16) is of size such that the stoppered cord (100) cannot be pulled back through it (16) during exercise. Also in all cases, a cord connecting slot (18) extending vertically across the face of the block (1) is of sufficient depth to provide an opening with the bore (16) along the lengths of both (16, 18). By reason of this novel element (18), one exercise cord (100) may be substituted for another (100) of different length or elasticity merely by stretching it (100) and slipping it (100) through the slot (16) where it (100) snaps firmly into place.

The simplest embodiment is a block (1) conveniently shaped for gripping in which the stoppered cord (100) extends from the bore (16) upward through the exercise operator's (200) fingers.

A second embodiment constitutes the block (1) as part of a stirrup shaped handgrip (150)—specifically, the part at which the exercise cord (100) connects. To arrive at this structure, the block (1) is considered to have what are designated herein as prongs (20) attached to it (1). A gripping pin (25) connects the ends of the prongs (20) to complete the stirrup shaped loop.

In the third embodiment, the block (1) comprises strap channels (31) through which the ends (311) of a handgrip strap (310) ankle connecting strap (316) or impinging assembly strap (319) are passed for self attachment so as to fashion, respectively, a considerably improved strapped handgrip assembly (151), strapped ankle exercise cuff assembly (314) or an anchoring door impingement assembly (313). The unique channels (31) of this embodiment of the invention make possible the connection of various prior art assemblies such as those (310, 151, 314) exemplify The connection of handgrip strapping (310) to the cord anchor block (1) immediately suggests an additional way by which a door impingement assembly (313)—a well known exercise anchoring device—may also be connected to it (1). Thus, regardless of the particular type of representative handgrip (850) or ankle exercise cuff assembly (314) employed, a second anchor block (1) is connected at the cord (100) end to be anchored. The impingement strap (319) connects to the block (1) in the same way a handgrip strap (310) or an ankle connecting strap (316) does. A first representative handgrip (850) may also be interconnected with a second one (850) for exercises widely recognized as the "chest pull" type. An ankle exercise cuff assembly (314) may be similarly connected to another (314) to permit reciprocal and various other leg movement exercises. Moreover, a cord anchor block (1) comprising additional cord terminal bores (16) also permits additional elastic cords (100) to be connected.

The connection of ankle connecting strapping (316) to the cord anchor block (1) also provides a way by which an ankle exercise cuff assembly (314) may be connected to it (1), accomplished merely by attaching to an ankle encircling band (315) short segments of the strapping connected by sewn attachment to the block (1).

It is the slotted feature of the structure which provides the inventive characteristics hereof in all three types of representative handgrips (850) as well as in the numerous connection combinations thus suggested.

BRIEF DESCRIPTION OF THE DRAWINGS

Solid lines in the drawings represent the invention. Dashed lines represent either noninventive material; that not incorporated into an inventive combination hereof and which may be the subject of another invention; or that which although so incorporated, lies beyond the focus of attention.

FIGS. 11–17 are intended to symbolically portray within each rectangle not only a representative handgrip (850), however, but other types of operator manipulators as well, including an ankle exercise cuff assembly (314). Alternative uses in combination are discussed ante.

In FIG. 18, the prior art object connected to the block (1) through the strap channels (31) is a strapped handgrip assembly (151). In FIG. 10, it is a door impingement assembly (313; in FIG. 19, an ankle exercise cuff assembly (314).

DESCRIPTION OF THE PREFERRED EMBODIMENT

The subject of this application comprises a slotted exercise handgrip disposed in various embodiments, each comprising in chief a cord anchor block(1).

Figure 1:
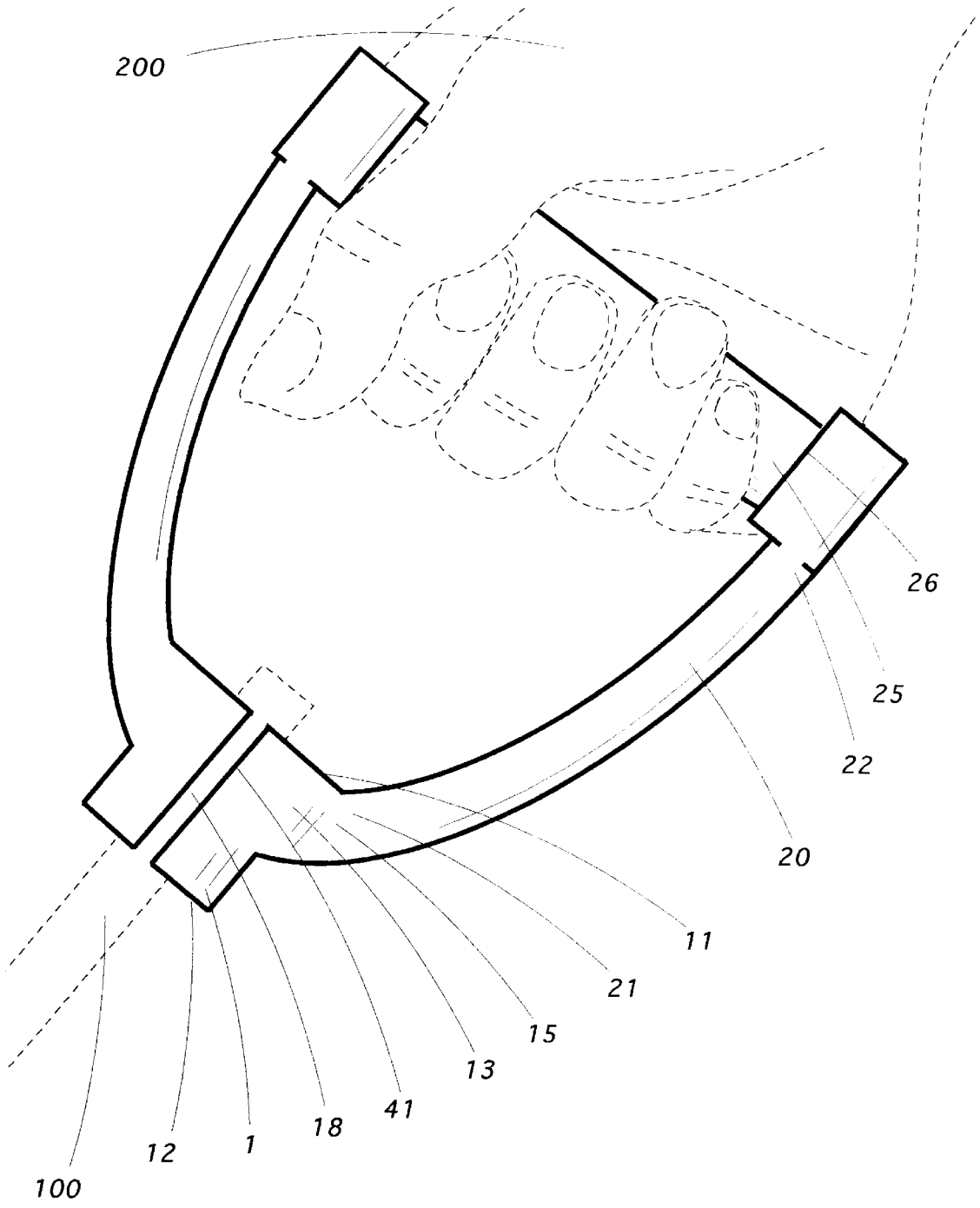
FIG. 1 represents the slotted cord anchor block (1) with handgrip prongs (20) extending therefrom so as to configure the structure as an enclosed loop or stirrup handgrip (150). The cord connecting slot (18) comprises straight configuration (41). The gripping pin ends (26) connect with the prongs' distal ends (22) by means of journal and bearing connectors disposed such that the prongs' distal ends (22) and the gripping pins' ends (26) may be snapped together to permit pin (26) rotation.
Figure 8:
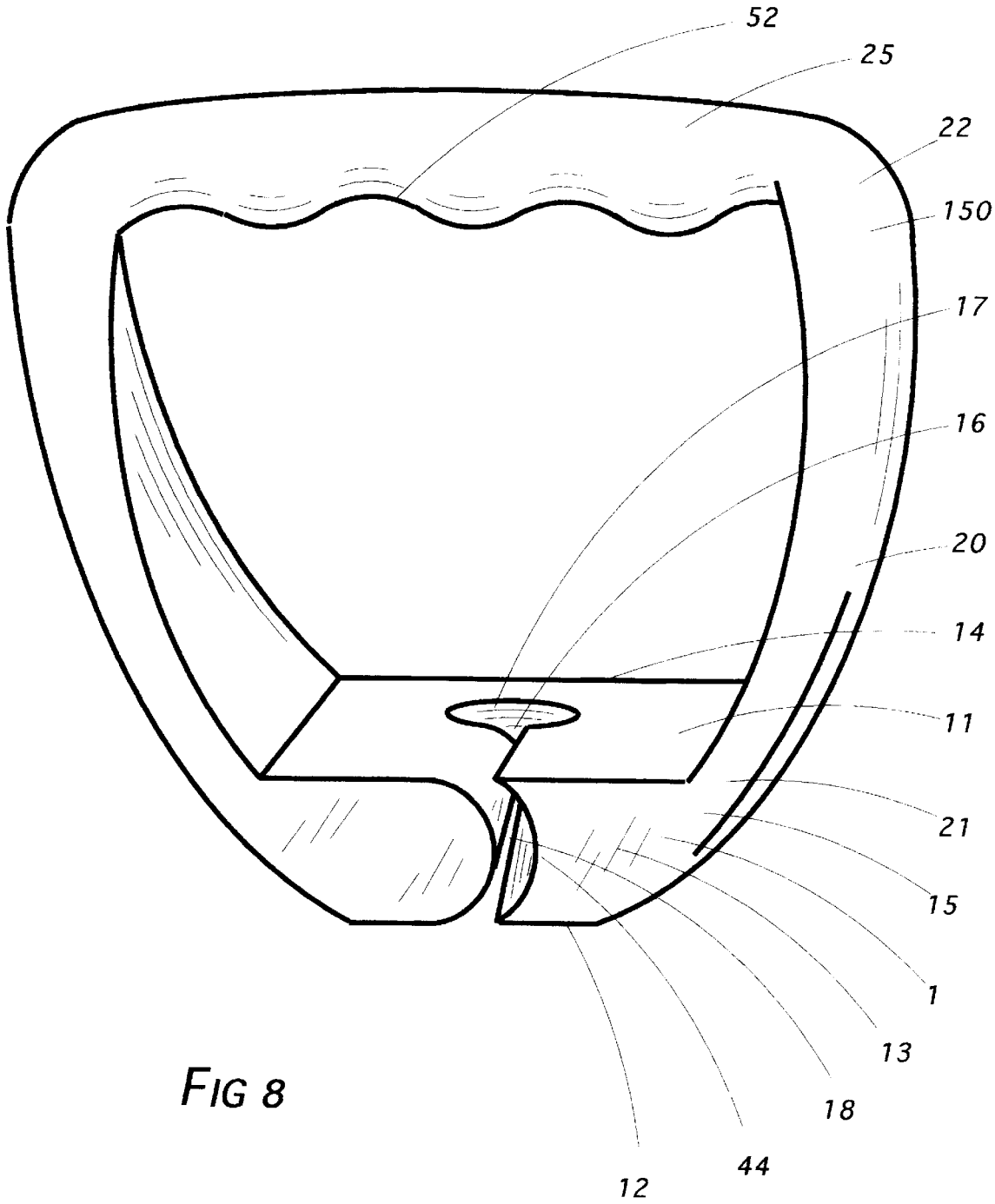
FIG. 8 demonstrates an anchor block (1) to which handgrip prongs (20) have been integrally attached, the structure comprising a curved slot (44) and a gripping pin (25) which is integrally attached between the prongs' distal ends (22). By reason of the inclusion of the prongs (20) and gripping pin (25), the entire unit is made to comprise an enclosed loop or stirrup handgrip (150). In this construction, the integral, or seamless, attachment was obviously achieved during a molding process.

The cord anchor block (1) is configured with a top (11) with oppositely disposed bottom (12) a face (13) with oppositely disposed backside (14); and opposing ends (15). The block itself (1) may be shaped in simple rectilinear bar form as shown in FIGS. 2, 3, 7, 9, 10, 18 and 19. FIGS. 1 and 8 are considered for purposes of this application to comprise the bar structure, although in those two instances, each is also equipped with handgrip prongs (10) and a gripping pin (25).

For ergonomic gripping convenience, the anchor block (1) may be curved to fit one's hand and comprise flattened ellipsoidal (88) or any other convenient configuration, including a banana shaped one (89). When the block (1) is integrally made part of a solid handgrip disposed in the form of a loop or stirrup (150), discussed ante, in which attached handgrip prongs (20) extend upward from the block's ends (15), a design which artistically blends the two elements in form, such as that shown in FIGS. 1 and 8, is preferred.

When the block (1) is incorporated as part of a strapped handgrip assembly (151), a door impingement assembly (313) or an ankle exercise cuff assembly (314), strap channels (31), ante, and, in some cases, elastic sheet and strap channels (34), ante, are included.

The cord anchor block (1) comprises at least one cord terminal bore (16) disposed to pass through the block (1) from its top (11) to its bottom (12). The bore (16) comprises diameter at least equal to that of the exercise cord (100). Preferably, the bore's (16) diameter is slightly greater than that and tapers to greatest diameter at the top (11). This will dispose a suitable seating site for the stoppered portion of the cord (100).

To avoid cord (100) interchangeability difficulties discussed supra, the cord anchor block (1) also comprises a cord connecting slot (18) disposed across the block's face (13), extending from its top (11) to its bottom (12). The slot (18) is said herein to be in communication with the bore (16) along the respective lengths of both (16, 18). Thus, the slot is of depth sufficient to provide an opening from the block's face (13) into the bore (16) along its (16) entire height from the block's top (11) to its bottom (12).

The width of the slot (18) is substantially less than the diameter of the elastic exercise cord (100). An acceptable width may be satisfactorily arrived at by trial and error but experience has established that a slot (18) width of approximately one-eighth inch is generally acceptable for a cord (100) diameter of approximately three-eighths inch. It is necessary to stretch the selected portion of cord (100) to compromise or reduce its (100) effective width to a size which allows it (100) to be slipped into place. This operation, thus, requires forcing it (100) through the slot (18). The tension manually imposed upon the cord (100) in stretching it (100) is then relaxed so that the cord (100) expands resiliently to its (100) normal width within the bore (16). The narrow width of the slot (18) relative to the cord's (100) diameter—now elastically normalized—makes it less likely than otherwise the cord (100) will be pulled out of place during exercise. Of course, the contribution to security of the stoppered sector of the cord's (100) impingement within the terminal bore (16) is indispensable during exercise. Nonetheless, the narrower the slot (18) relative to the width of the cord (100), the less likely accidental release will occur. While the connection between cord (100) and block (1) is a dependable one, the relative ease with which it is accomplished permits its characterization herein as one of emplacement.

Experience demonstrates that although a straight slot (41, FIGS. 1, 4, 5, 10, 18 and 19) is acceptable in most instances, slot (18) configuration other than straight is superior, requiring only a little additional effort to slip the elastic cord (100) into place. Accordingly, a medially pointed protrusion slot (41, FIG. 6)—that is, one which deviates laterally from a vertically straight sector of the slot (18) and then returns to a point in general alignment with that sector, providing a more or less zig-zag appearance—is preferred. One preferential configuration includes a medially rectilinear slot (43, FIG. 7)—one which deviates in the manner of the pointed protrusion slot (42) but which traces out a pattern shaped in the form of a rectangle before returning to the point of alignment. The configuration might also be "7"-shaped (46, FIGS. 2 and 3)—somewhat resembling a strain relief peg used to anchor electrical cords to certain equipment. Other preferable configurations include a curved slot (44, FIG. 8) and a serpentine—or "S"-shaped—one (45, FIG. 9).

Figure 2:
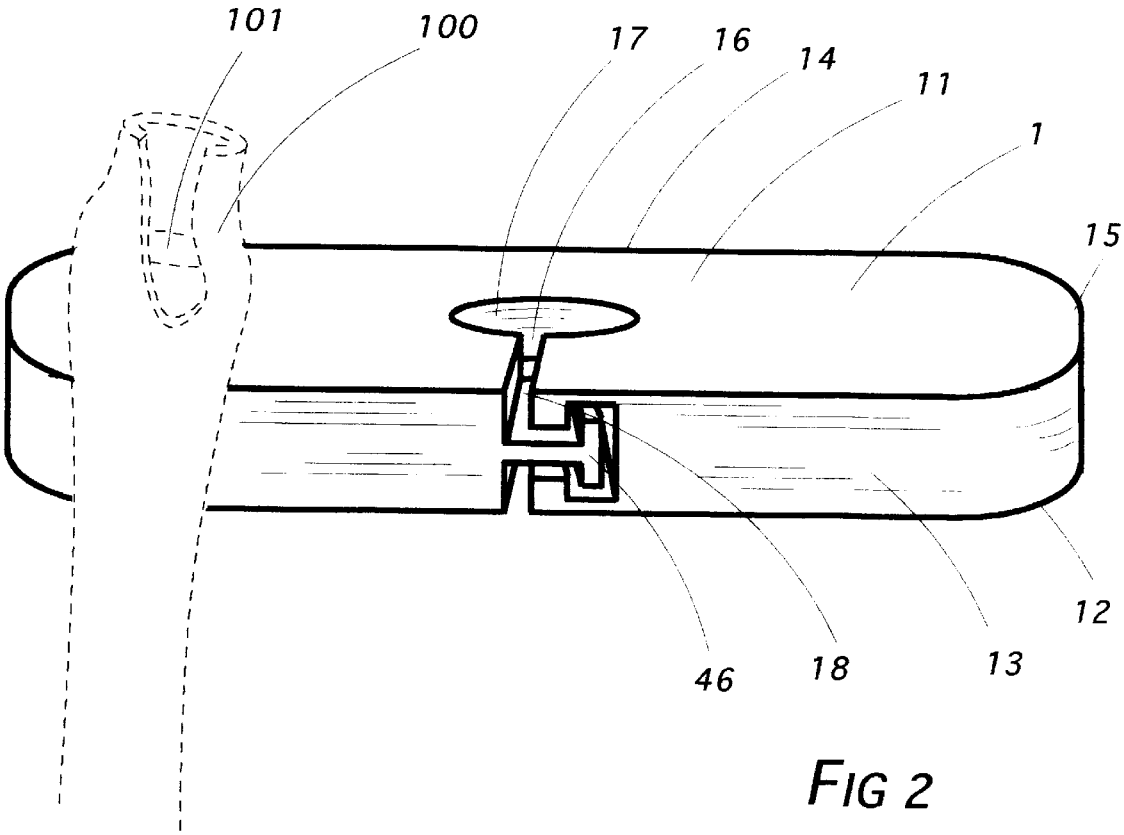
FIG. 2 depicts in perspective a simple cord anchor block (1) in which the cord connecting slot (18) is T-shaped (46). A length of stoppered elastic exercise cord (100) is positioned for stretching so as to be forced through the slot (18).
Figure 3:
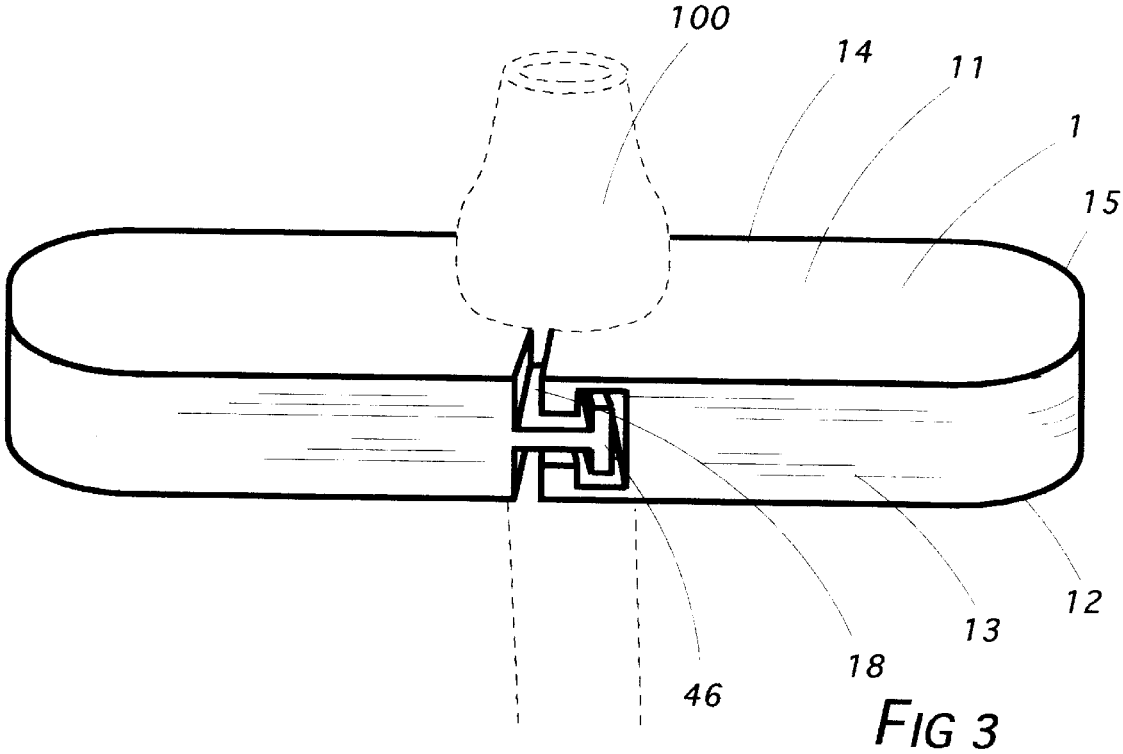
FIG. 3 illustrates the connection of the cord (100) to the block (1) depicted in FIG. 2.
Figure 4:
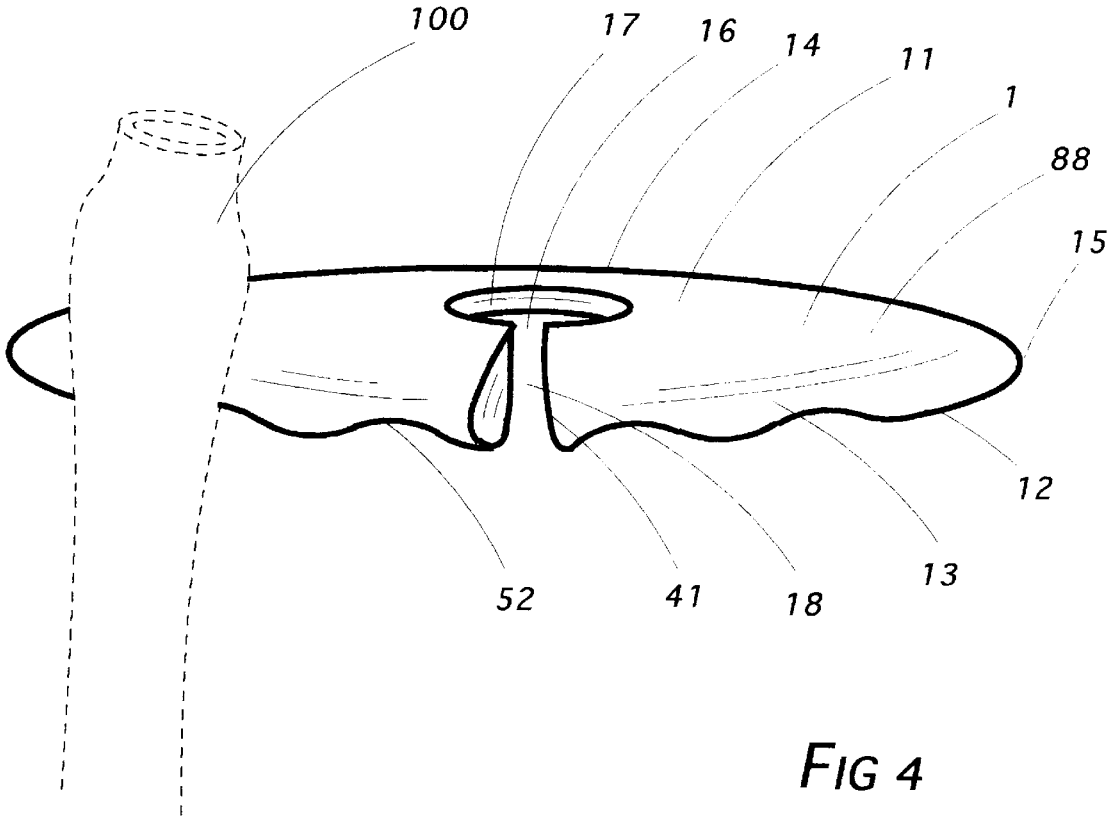
FIG. 4 represents a view of a flattened ellipsoidally configured anchor block (88) comprising finger guides (52).
Figure 5:
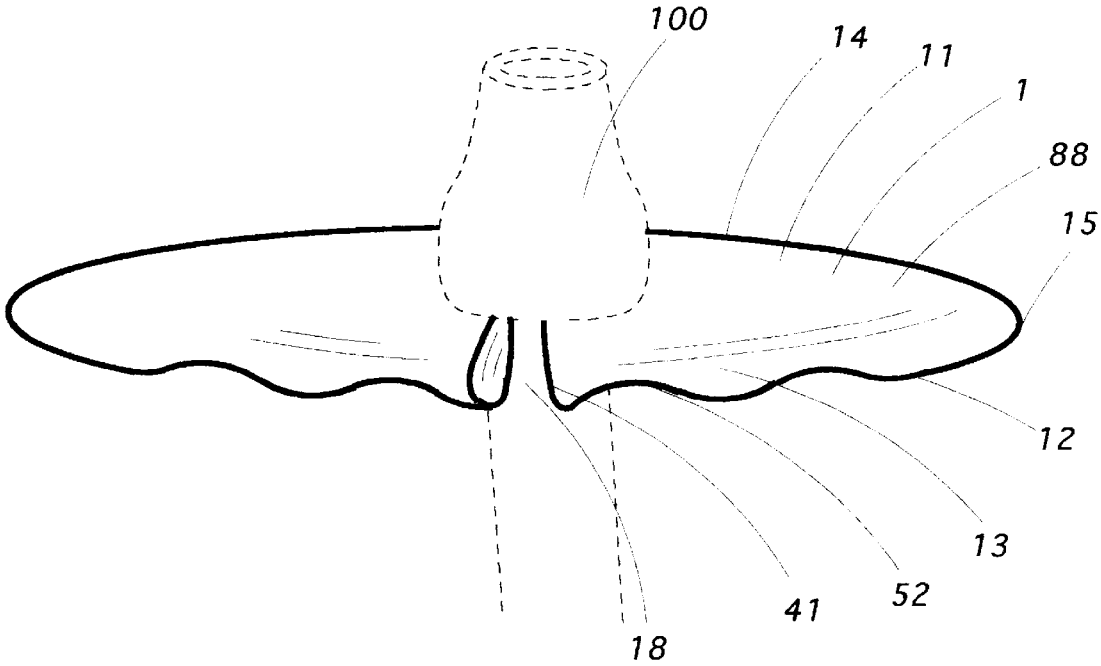
FIG. 5 illustrates the connection of the cord (100) to the block (1) depicted in FIG. 4.
Figure 6:
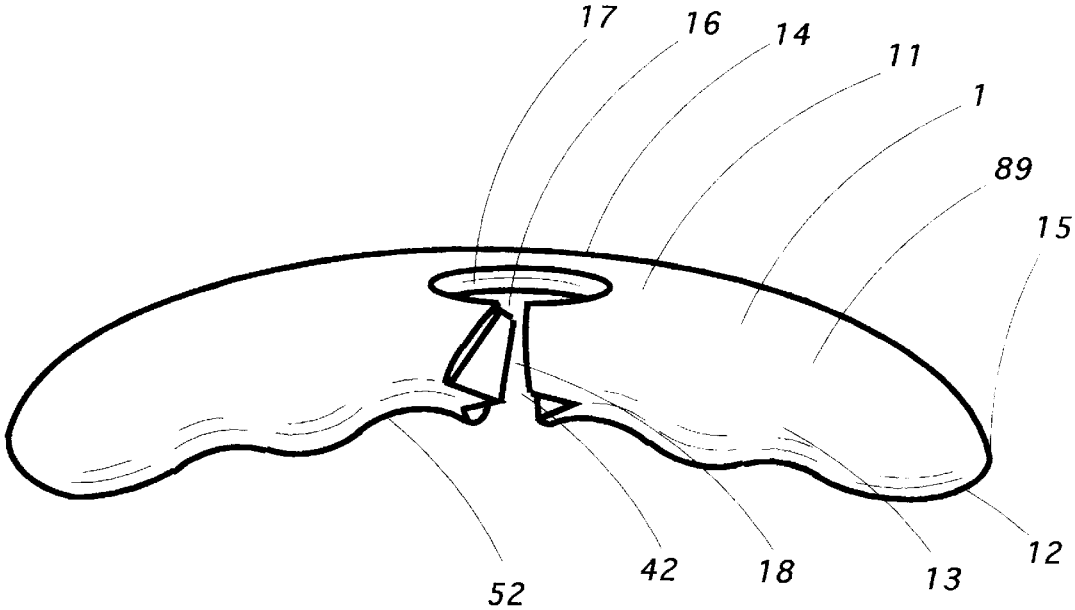
FIG. 6 depicts a banana shaped anchor block (89) comprising a medially pointed protrusion slot (42).
Figure 7:
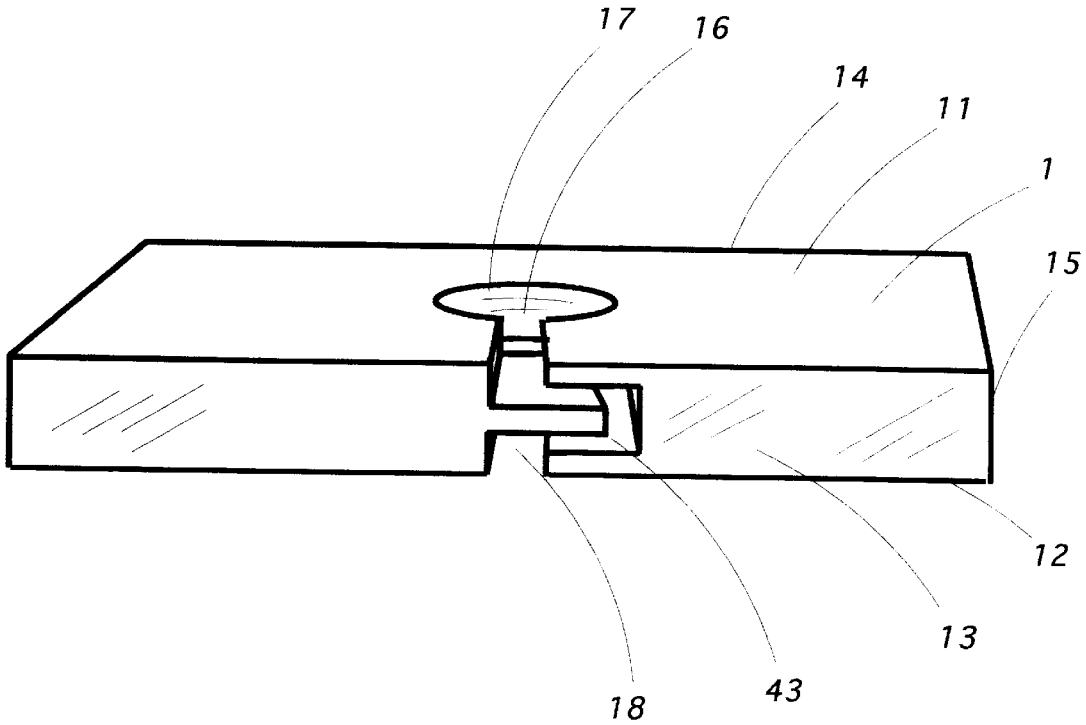
FIG. 7 features one (1) comprising a rectilinear slot (44).

The invention is best envisioned in its simplest forms—those shown in FIGS. 2 and 3, in which the cord anchor block (1) comprises simple rectilinear shape, and that shown in FIGS. 1, 4, 5, 10, 18 and 19, in which it (1) comprises a straight cord connecting slot (41). Thus, functionally speaking, an operator (200) would grip or hold a simple block (1) in his (200) or her (200) hand, allowing the stoppered cord (100, 101, FIG. 2) to extend upwards between the enclosing middle and ring fingers. However, by rounding off the block's (1) corners and adding finger guides (52) as illustrated in FIGS. 4 and 5, the invention's use is considerably enhanced. In the interest of ergonomics, the block (1) may even comprise an arcuate—or banana—shape (89) as shown in FIG. 6, a construction also comprising finger guides (52).

Currently more popular than the simple unadorned anchor block (1), however, is the enclosed loop or stirrup shaped handgrip (150) in which the exercising operator (200) holds a gripping pin (25) displaced from the point of connection with the elastic cord (100). a modified configuration of such a handhold is properly includable as a particular embodiment of the invention. All that need be done to attain that design and functionality is to attach a pair of handgrip prongs (20) to the anchor block (1). The prongs (20) are configured as somewhat elongated structures, each with a proximal end (21) and a distal one (22). In this embodiment, the proximal end (21) of each prong (20) is attached to a respective anchor block end (15). Preferably, the attachment is integral with the block (1) as shown in FIGS. 1 and 8, effected as a simple matter of casting or molding. However, should other kinds of attachment be desired in manufacture-say, by screws of other mechanical means-separate pieces may be interconnected in that fashion.

In any event, the prongs (20) must extend upward away from the block (1) in the same plane as one another generally parallel to the block's face (13) and backside (14). Preferentially, since the bore (16), supra, is disposed to extend from the block's top (11) to its bottom (12), the prongs (20) and the axis of the bore (16) in a general sense, share the same plane. Moreover, the extension of the prongs (20) from the block (1) should be symmetrical and the axis of the bore (16) lined up with a point midway between the prongs' distal ends (11).

To complete the structure of this embodiment of the invention, an operator gripping pin (25) is interposed between and connected to each prong's distal end (22). The pin (25) is configured as a somewhat elongated rod-like structure with opposing ends (26). Consistent with a practice well known to prior art, each of the pin's ends (26) may be attached to the prongs' respective distal ends (22). Any type of attachment may be undertaken but as with the attachment of the prongs' proximal ends (21) to the anchor block(1), supra, the attachment of each of the gripping prin's ends (26) to the prongs' respective distal ends (22) may be effected integrally, as shown in FIG. 8. This configuration now places the axis of the cord terminal bore (16) and prongs (20) and the gripping pin (25) generally within the same plane. Finger guides (51) similar to those considered for the anchor block (12) may be shaped into the pin (25) in the manner well known in the art.

Thus, by reason of the imposition of certain limitations, the cord anchor block (1) has now been modified to take the general shape of a conventional closed loop or stirrup shaped handgrip (150), albeit one of very special type by reason of the novelty herein incorporated into it (1)—one which permits quick exercise cord (100) interchangeability.

In manner similar to that by which the anchor block (1) may be modified to provide well recognized closed loop or stirrup configuration (150)—what is often comparatively referred to as the "solid" handgrip—limitations may also be applied to embellish the block (1) so as to provide special types of grips or other operator (200) manipulators resembling in other respects the well known strapped handgrip assembly (151) or the ankle exercise cuff assembly (314). These limitations may also permit the invention's employment as part of a door impingement assembly (313).

As briefly mentioned supra, to adapt the features disclosed herein to the strapped handgrip assembly (151), the door impingement assembly (313) or the ankle exercise cuff assembly (314), at least one pair of strap channels (31) is disposed in the anchor block (1), extending from its top (11) to its bottom (12). A single pair of strap channels (31) permits the insertion of each strap end (311) through a respective channel (31), such that it (311) may either be looped back upon the strap (310, 316, 317) and sewn in place as shown in FIGS. 9, 10,18 and 19 or attached by other means. Preferably, for the sake of obstruction avoidance and appearance, the strap end (311) is run such that it (311) is inserted upwardly—that is, toward the gripping cylinder (312), if present, in the case of a strapped handgrip assembly (151); the ankle encircling band (315) in the case of an ankle exercise cuff assembly (314); or the impinged end of a door impingement assembly (313).

If two pairs of strap channels (31) are present, such that two adjacent channels (31) are disposed proximate each of the block's ends (15), each end (311) of a strap (310, 316, 319) may be inserted downward through one of the respective channels (31) and then back upward through the adjacent one (31) for attachment to provide the closed handhold loop. A pair of elastic sheet and strap channels (34) also serves to fulfill this function when but a single pair of strap channels (31) is present with them (34).

Figure 9:
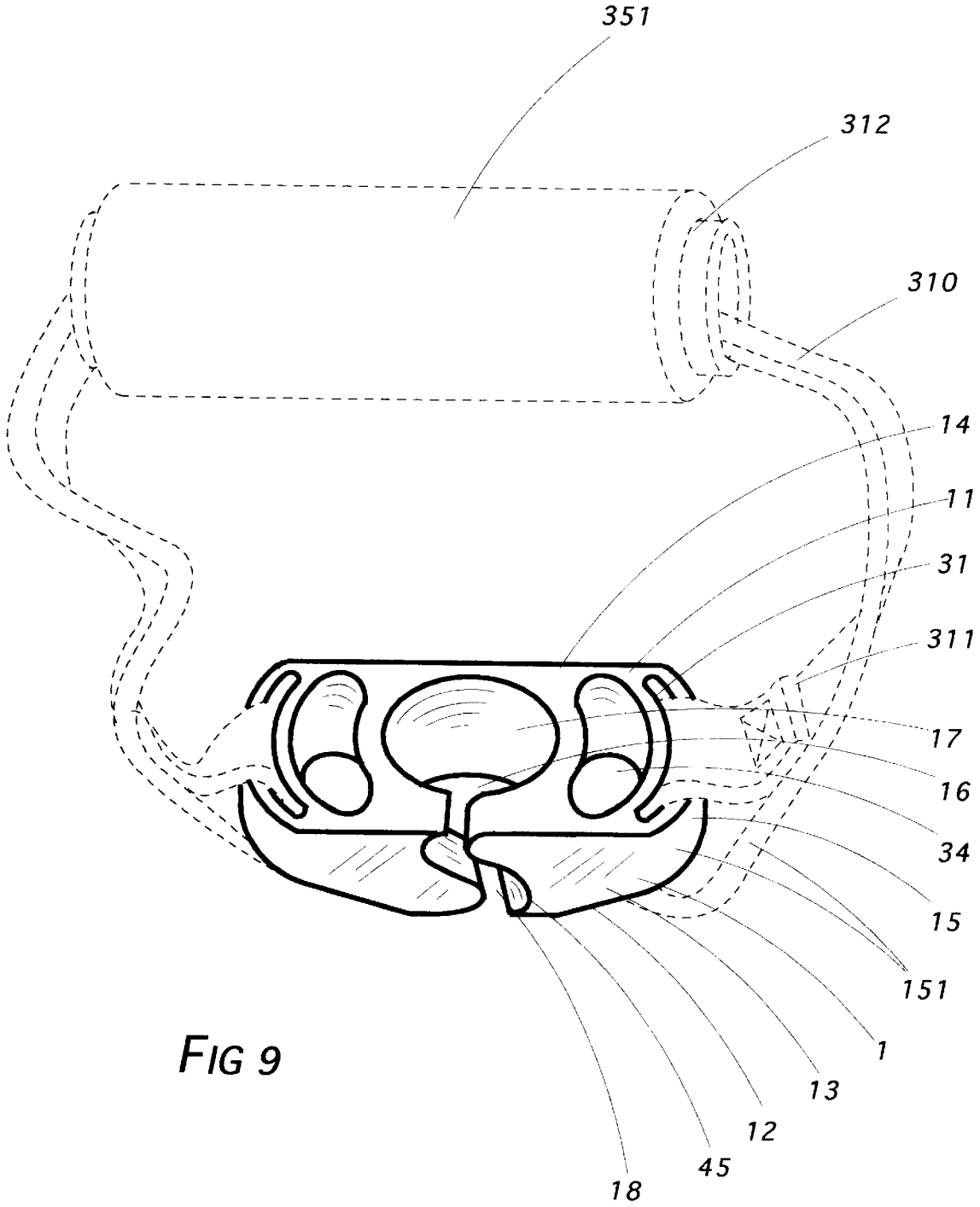
FIG. 9 comprises a block (1) comprising a serpentine slot (45), handgrip strapping (310) and a gripping cylinder (312) enwrapped with a gripping pad (351). The strapping (310) is connected to the block (1) through strap channels (31) by means of stitched self attachment—that is, the straps (310) are sewn back upon themselves (310). The components are disposed to comprise the entire unit a special type of strapped handgrip assembly (151) by means of insertion through strap channels (31) and stitched self attachment. Elastic sheet and strap channels (34) are also present.
Figure 18:
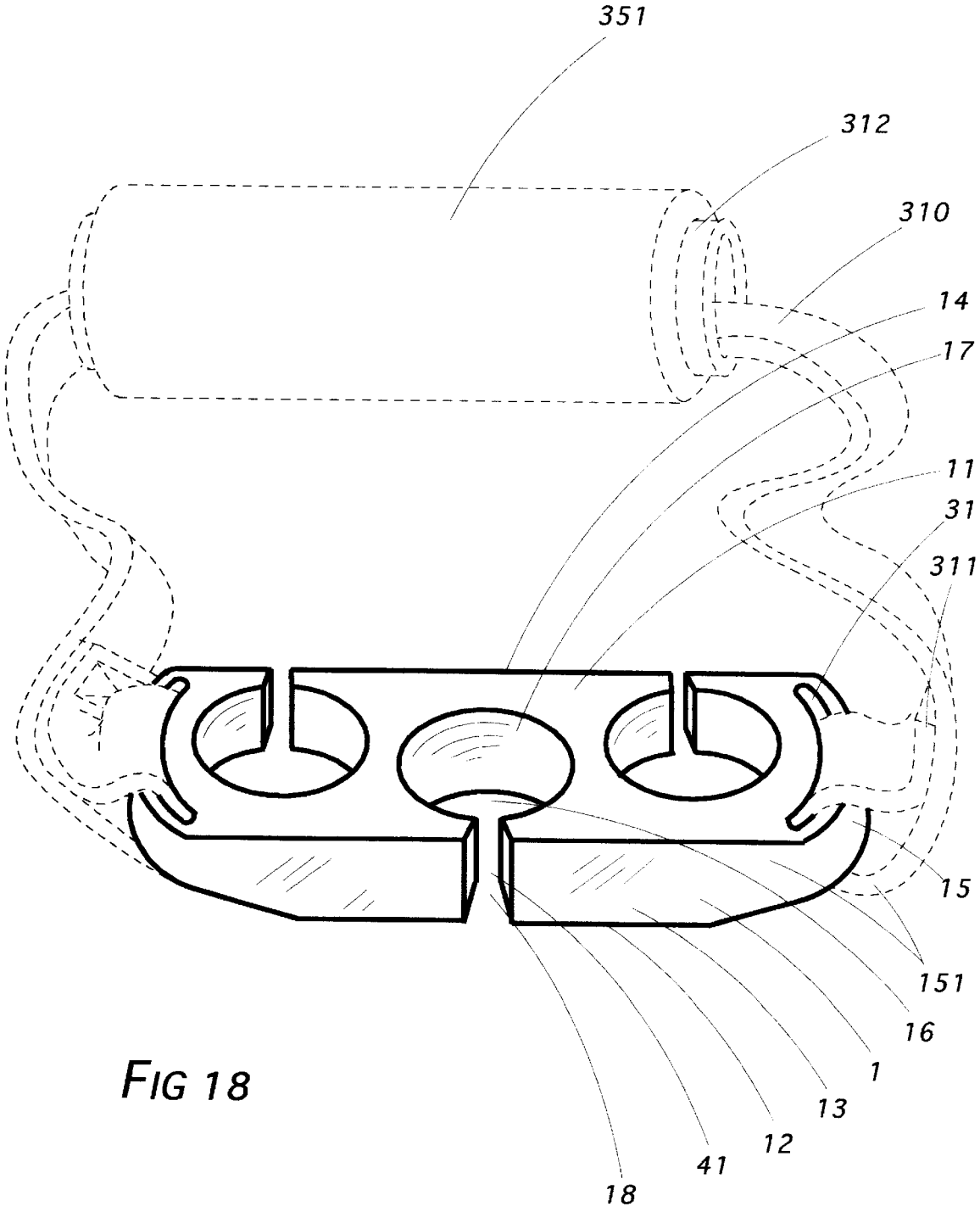
FIGS. 18 and 19, like FIG. 10, feature an anchor block (1) comprising three deliberately misaligned cord terminal bores (16), each accessible through one of three straight slots (41).

In the case of a strapped handgrip assembly (151), consistent with the known art, a gripping cylinder (312) may be incorporated through which, the strapping (310) runs as shown in FIGS. 9 and 18. The cylinder (312) is obviously connected before stitching is undertaken, the connection thereby comprising one of what might be designated as a more or less loose attachment.

As illustrated in FIGS. 9 and 18, the gripping cylinder (312) may comprise a gripping pad (351) disposed longitudinally upon it (312), meaning that the pad (351) is axially enwrapped in prior art fashion around the cylinder (312) along its (312) length. A gripping pad (351) may similarly be disposed upon the gripping pin (25) or an enclosed loop or stirrup configured handgrip (150).

Thus—as in the case of the specially configured solid handgrip (150), supra—by imposition of the limitations which are the subject hereof, a special type of strapped handgrip assembly (151), door impingement assembly (313) or ankle exercise cuff assembly (314), all known in other lesser respects to prior art, is made possible which incorporate features permitting quick and convenient cord (100) interchangeability.

Figure 10:
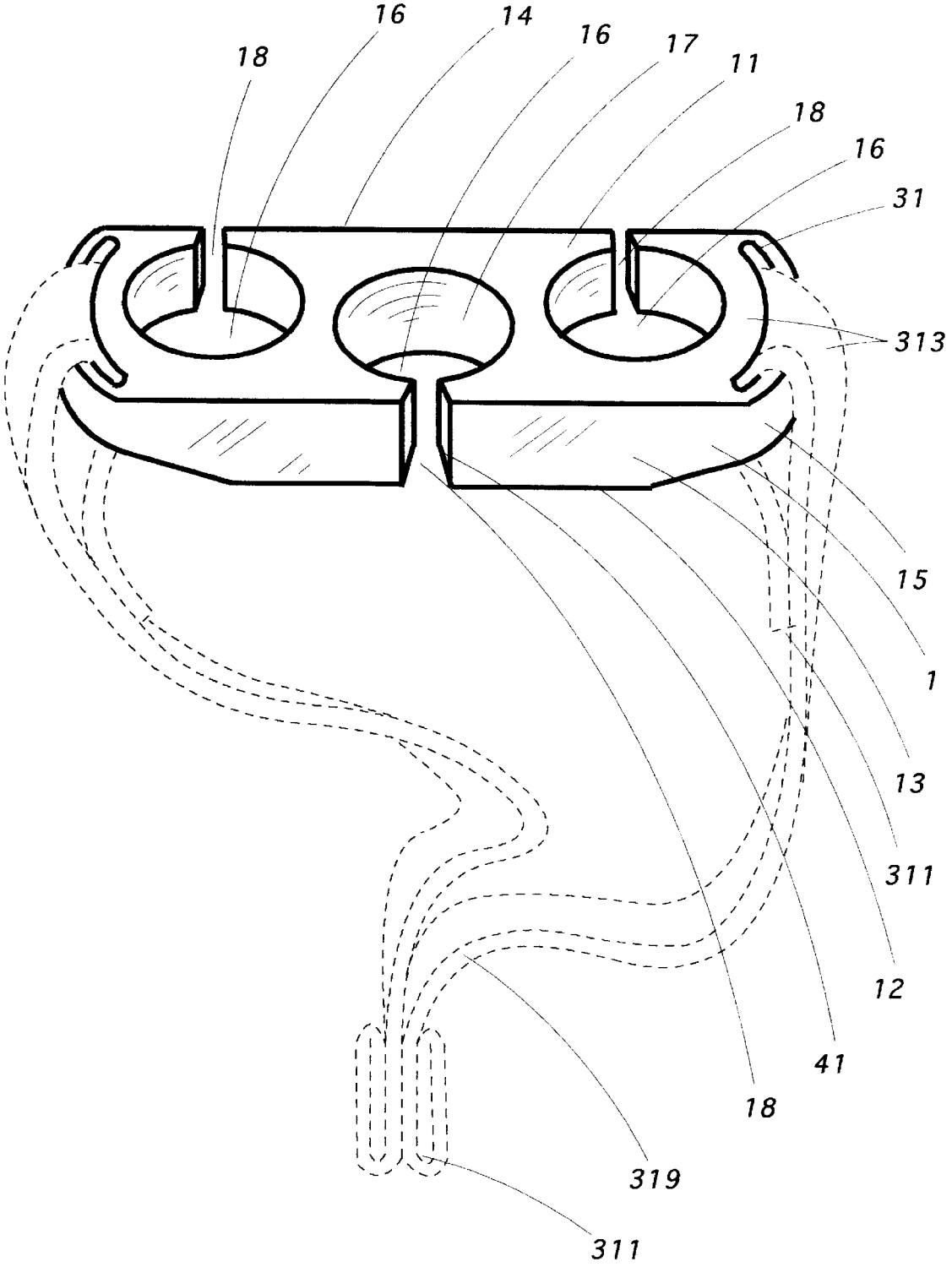
FIG. 10 depicts an anchor block (1) comprising three cord terminal bores (16), the centermost of which (16) is disposed in deliberate misalignment with the other two (16), ante. The block (1) comprises a straight slot (41). A door impingement strap (313) is connected to the block (1) through the strap channels (31).

As shown in FIG. 10, the same material employed in handgrip strapping (310) may be configured to comprise a door impingement strap (319), a key component of the door impingement assembly (313) known to prior art which provides a secure anchoring point (413) for exercise purposes. By incorporating the cord anchor block (1) as part of the structure of a door impingement assembly (313), however, the interchangeability sought for supra may be provided.

By including additional cord terminal bores(16) in the structure, considerable flexibility in use is provided. Thus, considering only operator (200) manipulators requiring use of the hands, any of the three general types of representative handgrips (850)—the simple bar or block (1), the solid handgrip identified herein as an enclosed or stirrup one (150) and the strapped handgrip assembly (151)—may be used in conjunction with a door impingement assembly (313) or with each other (1, 150, 151, 313, respectively. One or more of such representative handgrips (850) are shown in each of FIGS. 11–17. In any of these symbolic representations, an ankle exercise cuff assembly (314) may, of course, be substituted for any representative handgrip (850).

Figure 11:
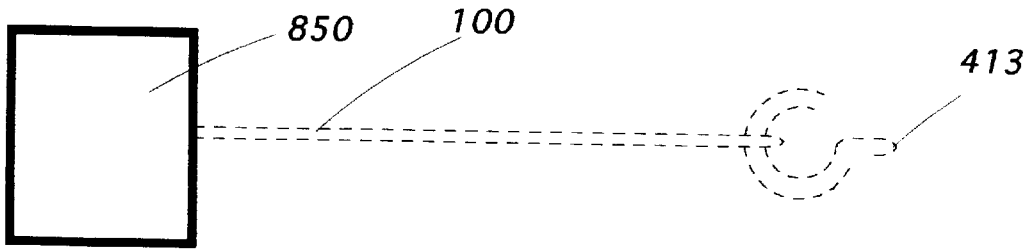
FIGS. 11–17 comprise a series of symbolic illustrations in which the large rectangles each represent any type of handgrip—or representative handgrip (850) as referred to herein—including the simple structures depicted in FIGS. 2–7 (the simple rectangular structure of 1 in general, 88, 89), the solid one referred to herein as the enclosed loop, stirrup or horseshoe shaped configuration (150) or the strapped assembly (151), all three of which types share the common feature of a cord anchor block (1) as a part or all of the complete structure.
Figure 12:
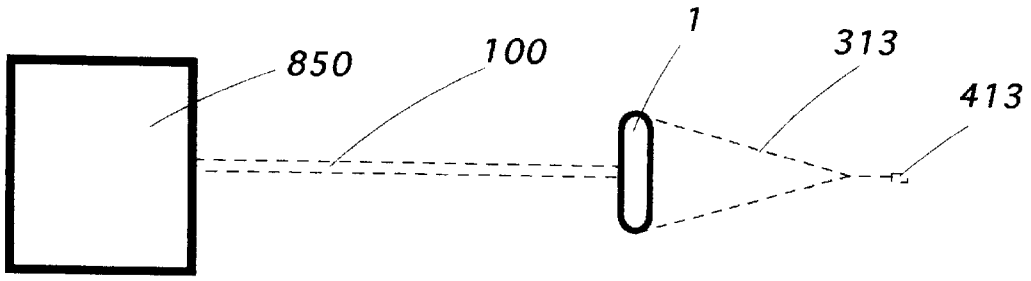
Figure 13:
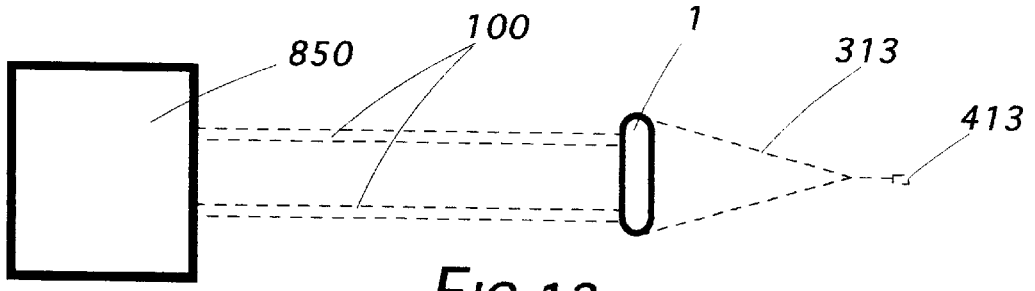
Figure 14:
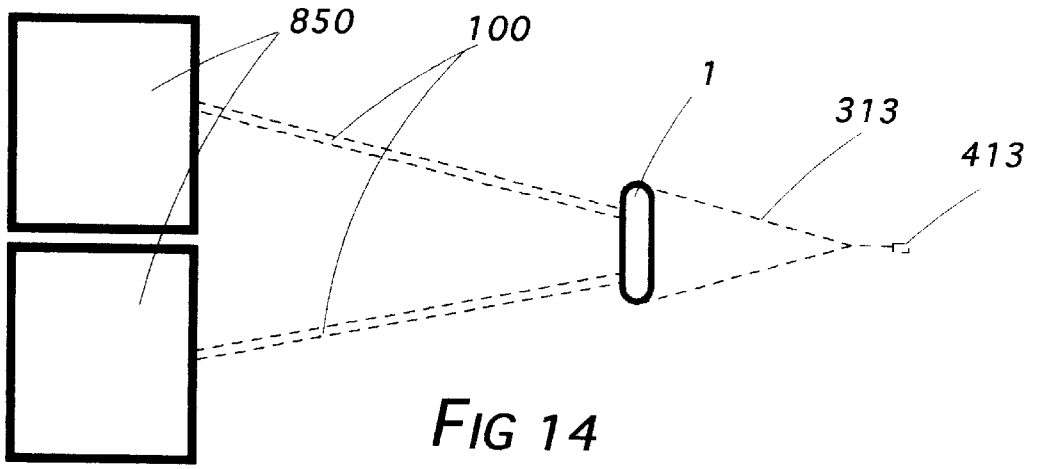
Figure 15:
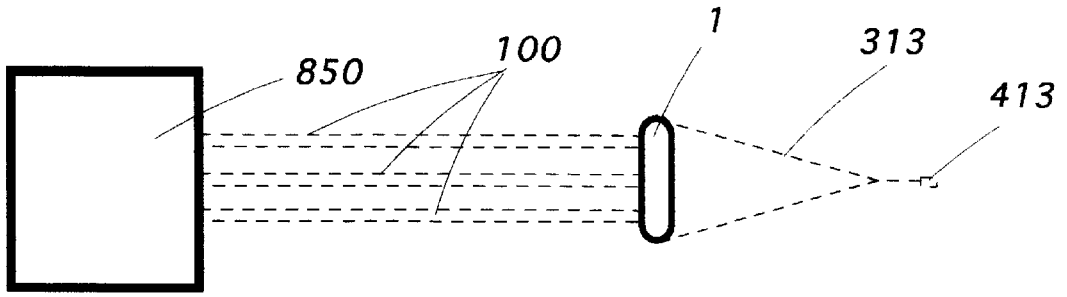
Figure 16:
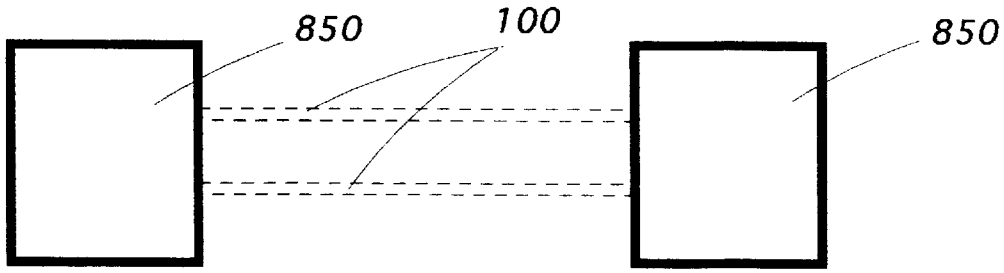
Figure 17:
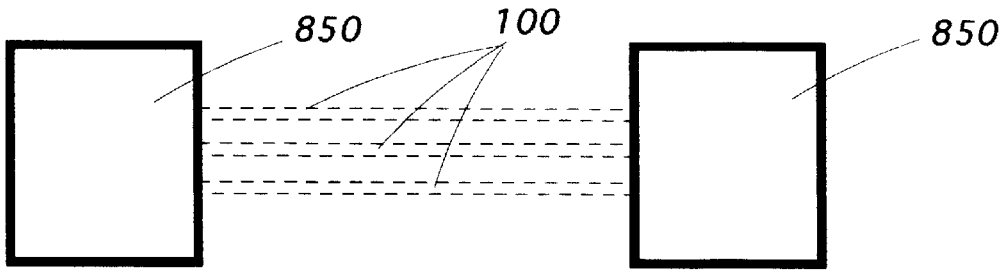

In FIG. 11, a representative handgrip (850) is shown with an elastic exercise cord (100) connected to a simple anchoring point (413). FIG. 12 illustrates the interconnection of a representative handgrip (850), single cord (100), anchor block (1) and door impingement assembly (313). In FIG. 13, two cords (100) are employed, an arrangement made possible by the presence of more than one terminal bore (16) in the representative handgrip (850) and the block (1) to which the impingement strap (319) is connected. FIG. 14 shows the use of two representative handgrips (850)—one for each of the operator's (200) hands—and the same other apparatus depicted in FIG. 13. In FIG. 15, three cords (100) are interconnected, thereby conveniently providing increased resistance with security. Two representative handgrips (850)—for use as what is widely recognized as a "chest pull" exercise—are shown in FIGS. 16 and 17. The latter features three cords (100), however. Symbolically, FIGS. 16 and 17 also represent the use of a pair of opposing ankle exercise cuff assemblies (314). In either of those depictions, of course, no more than one cord (100) could instead be employed.

The assembly in FIG. 18 is typical of the many ways the invention can be employed. In that depiction, the same cord anchoring block (1) shown in FIG. 10 is combined with the same strapped handgrip assembly (151) illustrated in FIG. 9, permitting for example, either of the elastic cord (100) connections shown symbolically in FIGS. 16 or 17 for any representative handgrip (850) .

Figure 19:
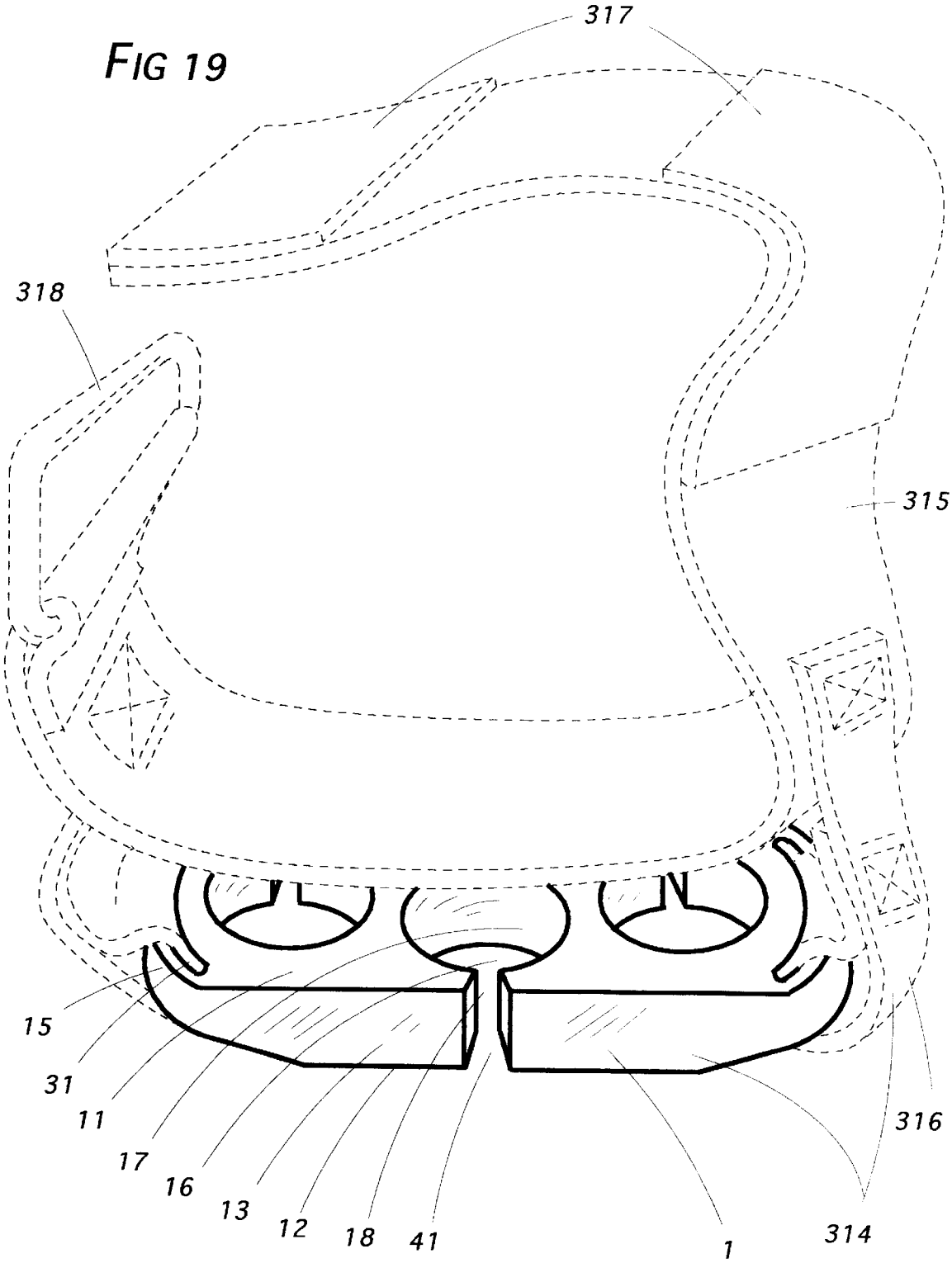

The ankle exercise cuff assembly (314) depicted in FIG. 19 exemplifies a connection of typical prior art material to the invention—specifically in this case, a cord anchoring block (1) comprising a pair of opposing strap channels (31) for the purpose. As indicated therein, two opposing ankle connecting straps (316)—or what might be equally well considered the two parts of a severed singular strap—are connected by sewn attachment to an ankle encircling band (315). In generally recognized prior art fashion, the band (315) is transversely severed at a point along its midlength, preferably with opposing miniature hook and eye fastening pads of the Velcro® sort (317) threaded through a belt connecting ring (318). However, the connecting means may also be acceptably configured in some other manner, such as that essentially represented in the vein of the common prior art belt buckle. For the sake of comfort, it is preferable that the encircling band (315) comprise greater width than that of the connecting straps (316), but that is a matter of prior art, not of the invention hereof.

I claim:

1. A slotted exercise handgrip comprising a cord anchoring block shaped for ergonomic gripping convenience with a top and oppositely disposed bottom, a face and oppositely disposed backside and opposing ends and comprising:

one or more terminal bores disposed to pass through the block from top to bottom; and one or more cord connecting slots disposed across the block's face from its top to its bottom, each slot disposed in communication with a respective terminal bore along the respective lengths of both the slot and the bore;

whereby one or more hollow exercise cords comprising width greater than that of each respective connecting slot and further comprising in each a cord terminal stopper may be easily and securely connected to the block by forcing a stretched length of each thereof through a respective cord connecting slot.

2. The slotted exercise handgrip according to claim 1 comprising a pair of handgrip prongs and a gripping pin, each of the prongs in turn comprising a proximal end and a distal end, each proximal end disposed by attachment to a respective anchoring block end so as to extend the prongs generally along a plane parallel to the block's face and backside;

the gripping pin comprising opposing ends, each connected to a prong's respective distal end so as to form a loop configuration; wherein stirrup or horseshoe shaped handgrips are provided.

3. A slotted exercise handgrip according to claim 1 comprising at least one pair of strap channels;

so that a handgrip strap or a door impingement strap disposed to form a loop may be connected to the anchoring block by inserting the strap ends through respectively disposed strap channels and attaching the ends thereof back upon the strap to form a loop configuration.

4. The slotted exercise handgrip according to claim 2 wherein the means of the gripping pin's connection to prongs comprises journal and bearing configuration;

whereby handgrip use is enhanced by reason of free rotation.

5. The slotted exercise handgrip according to claim 1 wherein each cord connecting slot comprises straight configuration.

6. The slotted exercise handgrip according to claim 1 wherein each cord connecting slot comprises medially pointed protrusion configuration;

so that connecting security is enhanced.

7. The slotted exercise handgrip according to claim 1 wherein each cord connecting slot comprises medially rectilinear protrusion configuration.

8. The slotted exercise handgrip according to claim 1 wherein each cord connecting slot comprises medially curved configuration.

9. The slotted exercise handgrip according to claim 1 wherein each cord connecting slot comprises serpentine configuration.

10. The slotted exercise handgrip according to claim 1 wherein each cord connecting slot comprises T-shaped configuration.

11. The slotted exercise handgrip according to claim 1 wherein the anchoring block further comprises ellipsoidal configuration;

whereby operator control is enchanced.

12. The slotted exercise handgrip according to claim 1 wherein the anchoring block further comprises banana shaped configuration.

13. The slotted exercise handgrip according to claim 1 wherein the anchoring block further comprises finger guides;

whereby operator control is enhanced.

14. The slotted exercise handgrip according to claim 3 further comprising a gripping cylinder;

wherein handgrip use is enhanced by reason of free rotation.

15. The slotted exercise handgrip according to claim 3 wherein the attaching means comprises stitching.

16. The slotted exercise handgrip according to claim 14 further comprising a gripping pad disposed longitudinally upon the cylinder.

17. The slotted exercise handgrip according to claim 1 wherein at least one of the cord terminal bores are disposed in deliberate misalignment with the others.

* * * * *